US010239113B2

(12) United States Patent
Taylor et al.

(10) Patent No.: US 10,239,113 B2
(45) Date of Patent: Mar. 26, 2019

(54) NET SHAPED FORGING FOR FLUID ENDS AND OTHER WORK PIECES

(71) Applicant: ELLWOOD NATIONAL INVESTMENT CORP., Wilmington, DE (US)

(72) Inventors: Brian C. Taylor, Aliquippa, PA (US); Manas P. Shirgaokar, N. Cortland, OH (US); Erik J. Soderstrom, Sharpsville, PA (US); Gerhard Epp, Canfield, OH (US); Roger L. Garrett, New Wilmington, PA (US)

(73) Assignee: ELLWOOD NATIONAL INVESTMENT CORP., Wilmington, DE (US)

( * ) Notice: Subject to any disclaimer, the term of this patent is extended or adjusted under 35 U.S.C. 154(b) by 432 days.

(21) Appl. No.: 14/979,103

(22) Filed: Dec. 22, 2015

(65) Prior Publication Data

US 2016/0175918 A1 Jun. 23, 2016

Related U.S. Application Data

(60) Provisional application No. 62/096,187, filed on Dec. 23, 2014.

(51) Int. Cl.
*B21J 9/02* (2006.01)
*B21J 5/02* (2006.01)
(Continued)

(52) U.S. Cl.
CPC ..... *B21J 9/02* (2013.01); *B21D 53/00* (2013.01); *B21J 5/025* (2013.01); *B21J 5/08* (2013.01); *F04B 53/16* (2013.01)

(58) Field of Classification Search
CPC ..... B21J 5/008; B21J 5/02; B21J 5/025; B21J 5/08; B21J 5/12; B21J 9/02; B21J 9/06;
(Continued)

(56) References Cited

U.S. PATENT DOCUMENTS 2,159,329 A * 5/1939 Jackson ..... B21J 5/08 30/342
3,867,832 A * 2/1975 Rut ..... B21J 5/08 72/399

(Continued)

FOREIGN PATENT DOCUMENTS

GB 2242378 A 10/1997
WO 2013050935 A1 4/2013

OTHER PUBLICATIONS

Extended European Search Report for European Application No. EP15200598.9, (dated May 2016) (3 pages).

*Primary Examiner* — Matthew P Travers
(74) *Attorney, Agent, or Firm* — Cafardi, Ferguson, Wyrick, Weis + Stotler LLC; Andrew M. Gabriel

(57) ABSTRACT

An embodiment includes a method for net shape forging of a manifold block, comprising: starting with a single bar having a first cross-sectional area, placing a work piece area of the single bar in a die; and upsetting, via longitudinal movement of the single bar, the work piece area of the single bar in the die, wherein the single bar is pressed into the die to reduce its length; whereby the work piece area of the single bar is displaced to an increased cross-sectional area as compared to the first cross-sectional area. Other aspects are described and claimed.

9 Claims, 6 Drawing Sheets

(51) Int. Cl.
*B21J 5/08* (2006.01)
*B21D 53/00* (2006.01)
*F04B 53/16* (2006.01)

(58) Field of Classification Search
CPC ..... B21K 1/20; B23P 15/00; B23P 15/001; F04B 19/22; F04B 53/007; F04B 53/10; F04B 53/14; F04B 53/144; F04B 53/16; F04B 53/162; F05B 2230/25; Y10T 29/49236
USPC ..... 72/338
See application file for complete search history.

(56) References Cited

U.S. PATENT DOCUMENTS 4,838,062 A * 6/1989 Prenn ..... B21J 1/06 72/318
5,842,267 A * 12/1998 Biederman ..... B21J 5/12 29/558
6,571,596 B1 * 6/2003 Lindell ..... B21F 23/00 72/339
2006/0254338 A1 * 11/2006 Otaki ..... B21J 5/08 72/353.2
2006/0260380 A1 * 11/2006 Otaki ..... B21J 5/08 72/359
2007/0107484 A1 * 5/2007 Otaki ..... B21C 23/20 72/355.6
2012/0138199 A1 * 6/2012 Greubel ..... B21J 5/08 148/653
2013/0195701 A1 8/2013 Skurdalsvold et al.
2014/0083541 A1 3/2014 Chandrasekaran et al.
2014/0238099 A1 * 8/2014 Kalyani ..... B21J 5/025 72/341
2015/0128416 A1 * 5/2015 Fukuyasu ..... F16C 3/08 29/888.08
2015/0352627 A1 * 12/2015 Hood ..... B21F 5/005 72/356
2016/0346828 A1 * 12/2016 Kuwahara ..... B21K 1/12

* cited by examiner

SECTION A-A

NET SHAPED FORGING FOR FLUID ENDS AND OTHER WORK PIECES

CLAIM FOR PRIORITY

This application claims priority to U.S. Provisional Application No. 62/096,187 filed on Dec. 23, 2014 entitled "NET SHAPED FORGING FOR FLUID ENDS AND OTHER WORK PIECES" which is incorporated by reference herein in its entirety.

BACKGROUND

Forging is a manufacturing process where metal is pressed, pounded or squeezed (these terms are used interchangeably herein) under great pressure into high strength parts known as forgings. The process is normally (but not always) performed hot by preheating the metal to a desired temperature before it is worked.

The forging process can create parts that are stronger than those manufactured by any other metalworking process. This is why forgings are almost always used where reliability and human safety are critical. Forgings are often used as component parts contained inside assembled items such as ships, oil drilling equipment, engines, and many other kinds of equipment.

Forgings are typically completed by subjecting the forging to a machining or finishing process. The process of machining removes excess material from a forging using a machine tool.

Energy (oil and gas) mining operations utilize high pressure pumps that circulate drilling fluids, both injecting fluids into and discharging fluids out of the drill string equipment. The high pressure pumps include components designated as the "fluid end" that provide the function of a manifold block to facilitate fluid transfer during operation. These manifold blocks contain intersecting bores that provide passages for the drilling fluids.

Conventional manufacturing of these manifold blocks involves the acquisition of an alloy steel ingot from a melting source. Through open-die forging, the ingot is reduced to the form of a rectangular billet, representative in excess of the maximum height, width, and length of the manifold block. The service demands of this energy mining application require the highest quality in steel cleanliness and strength. Sections of the forged billet are removed through precision machining to create the manifold exterior geometry and series of intersecting central bores extending to the exterior block surfaces.

BRIEF SUMMARY

One embodiment provides a method for net shape forging of a manifold block, comprising: starting with a single bar having a first cross-sectional area, placing a work piece area of the single bar in a die; and upsetting, via longitudinal movement of the single bar, the work piece area of the single bar in the die, wherein the single bar is pressed into the die to reduce its length; whereby the work piece area of the single bar is displaced to an increased cross-sectional area as compared to the first cross-sectional area.

In an embodiment, the upsetting of the work piece area results in displacement of the work piece area into a shaped cavity of the die.

In an embodiment, the method may include moving the work piece area of the single bar longitudinally out of the die. The work piece area may be removed from the single bar as a net shape forged manifold block before or after pressing the next work piece. Additionally, a single manifold block may be formed, depending on the length of the bar.

In an embodiment, a new area of the single bar is introduced into the die as a new work piece area. A method may thus include upsetting, via longitudinal movement of the single bar, the new work piece area, wherein the single bar is pressed into the die to reduce its length.

In an embodiment, pre-treating of the single bar prior to forging the bar may be conducted. The pre-treating may include saw cutting the single bar. The saw cuts may be introduced at manifold block separation areas of the single bar.

In an embodiment, the manifold block is a fluid end.

An embodiment provides a product formed by a process, comprising: starting with a single bar having a first cross-sectional area, placing a work piece area of the single bar in a die; and upsetting, via longitudinal movement of the single bar, the work piece area of the single bar in the die, wherein the single bar is pressed into the die to reduce its length; whereby the work piece area of the single bar is displaced to an increased cross-sectional area as compared to the first cross-sectional area.

Another embodiment provides a net shape forge, comprising: at least one longitudinal pressing tool; at least one die having a cavity therein in a net shape of a manifold block; a processor operatively coupled to the at least one pressing tool; a memory storing instructions executable by the processor to: starting with a single bar having a first cross-sectional area, placing a work piece area of the single bar in the at least one die; and upsetting, via longitudinal movement of the single bar, the work piece area of the single bar in the at least one die, wherein the single bar is pressed into the at least one die to reduce its length; whereby the work piece area of the single bar is displaced to an increased cross-sectional area as compared to the first cross-sectional area The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
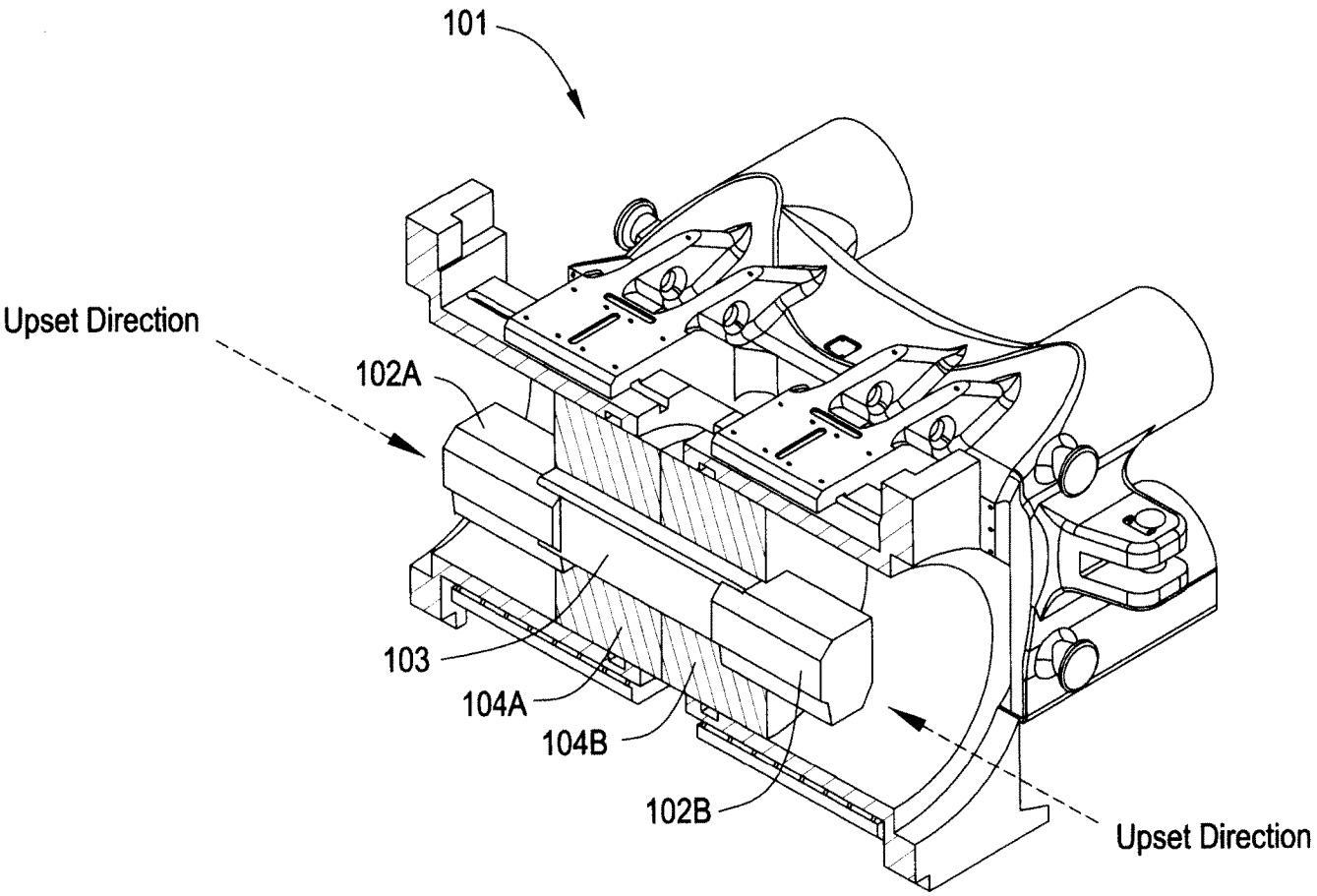
FIG. 1 illustrates a cross-sectional, perspective view of an example press having a work piece therein.

It will be readily understood that the details of the example embodiments, as generally described and illustrated in the figures herein, may be arranged and designed in a wide variety of different ways in addition to the described example embodiments. Thus, the following more detailed description of the example embodiments is not intended to limit the scope of the claims, but is merely representative of certain example embodiments.

Reference throughout this specification to "embodiment(s)" (or the like) means that a particular feature, component, step or characteristic described in connection with the embodiment is included in at least one embodiment. Thus, appearances of the phrases "according to embodiments" or "an embodiment" (or the like) in various places throughout this specification are not necessarily all referring to the same example embodiment.

Furthermore, the described features, components, steps, or characteristics may be combined in any suitable manner in different embodiments. In the following description, numerous specific details are provided to give a thorough understanding of certain example embodiments. One skilled in the relevant art will recognize, however, that aspects can be practiced without certain specific details, or with other methods, components, materials, et cetera. In other instances, well-known structures, materials, components, steps or operations are not shown or described in detail to avoid obfuscation.

Conventional manufacturing of a manifold block from an ingot/open-die forging includes a significant inefficiency in its production. The machining to create the exterior geometry, and its intersecting internal passages, generates significant material removal from the original as-forged shape. Typical material removal may exceed over one-half the mass from the initial forging to reduce its shape and produce the finished block. The machining-removal mass is rendered into the form of scrap, and is unusable to the finished product. The conventional manufacturing method may only yield one finished Fluid End per one as-melted steel ingot.

An embodiment provides an improved manufacturing method for manifold blocks through net shape forging for gas/fluid distribution blocks. Various embodiments described throughout represent methods that employ advancements in forging systems (advanced forge press installations) and forge production (advanced forge die designs), permitting the production of alloyed-steel forgings in the net shape outline of the finished manifold block product.

An input product into the net-shape forging process may be in the form of a forged or rolled alloy steel bar. The bar may be of circular or non-circular cross section. However, the cross-sectional area of the bar is less than the cross-sectional area of the final manifold block forged-shape. Through a series of program controlled upsetting and offsetting operations, the bar is gathered (upset), displaced outward from its central axis (offset), and formed into the final manifold block forged-shape.

The offset displacements of the net-shaped forging may not be of symmetrical geometry. As such, the final manifold block forged-shapes may be of more similar geometry to the finished product, yielding material savings and additional efficiencies during the final machining operations.

Concurrent with the net shape forging operation is the linear shortening of the input bar length, consumed as the material volume to provide the upset/offset formed geometries. As such, the number of consecutive final manifold block forged-shapes is limited only by the facility and commercial limitations for length of the input bar material. Multiple manifold block products may be produced from a singular input bar, significantly improving material yield from input through final product.

Improvements to conventional manufacturing of the manifold gas/fluid distribution blocks from an ingot/open-die forging provided by embodiments employing net shape forging include, but are not limited to: 1) efficiencies of material utilization when in the form of net shape forging for gas/fluid distribution blocks; 2) forging design permits minimal excess material to be removed during process machining to yield the finished manifold block; and 3) each melted steel ingot may now yield multiple rolled or forged bars, which in turn may yield multiple finished manifold block products.

Additional products that receive the benefits of improved material utilization efficiency from such net shape forging also include, but are not limited to: energy exploration components, power transfer shafting, machinery housing components, eccentric power delivery shafting, and gear interface shafting.

The illustrated example embodiments will be best understood by reference to the figures. The following description is intended only by way of example, and simply illustrates certain example embodiments.

FIG. 1 illustrates an example press 101 for net shape forging a manifold block. The press 101 is controlled to allow for precise part positioning before and after forging, aiding material ingress and egress from the press 101. Work piece 103 is shaped into a net shape by being gathered by operation of punches 102*a* and 102*b*, indicated by dashed arrows in FIG. 1 illustrating the upset directions. Dies 104*a* and 104*b* (two are shown here, although this is a non-limiting example) provide shaping to work piece 103, displaced work piece 103 outwardly from its central axis (offset) and forming it into the final manifold block net forged shape.

In FIG. 1 the press 101 is illustrated in cross section, as the net shape forging process is a closed die process. However, work piece 103 may take the form of an elongated bar (or other input material shape) such that multiple finished, net shaped blocks may be produced from a single bar in series, as further described herein. Thus, work piece 103 may exit one side of the press 101.

An input work piece 103 for the net-shape forging process may be in the form of a forged or rolled alloy steel bar. The bar may be of circular or non-circular cross section. The cross-sectional area of the bar is less than the cross-sectional area of the final manifold block forged-shape, i.e., it is gathered up or upset to reduce its length and increase its cross-sectional area into a final net forged shape.

Figure 2:
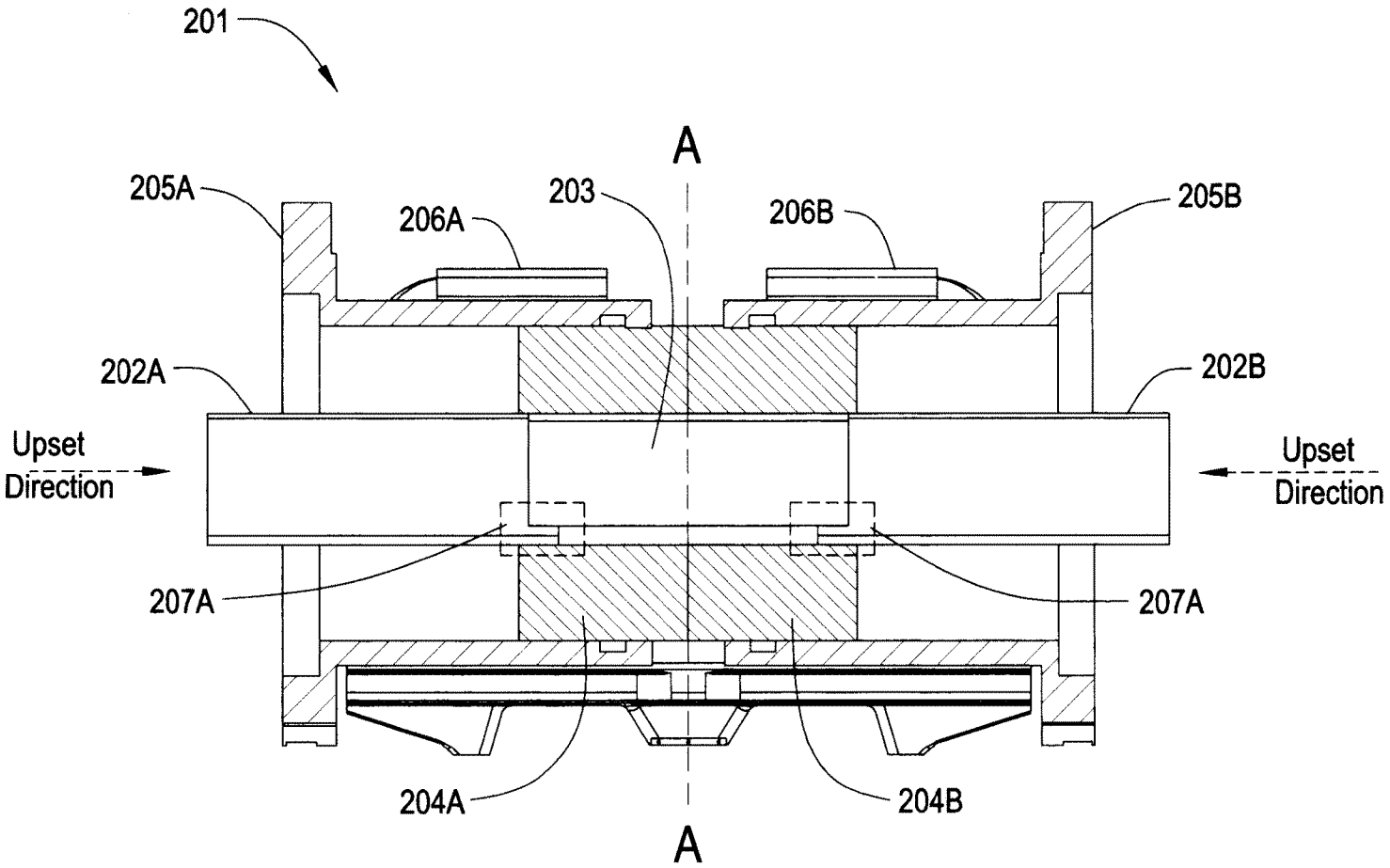
FIG. 2 illustrates a cross-sectional, front view of an example press having a work piece therein.

A cross-sectional view of the press 201 is provided in FIG. 2. As shown, the press 201 includes tool housings 205*a*, 205*b* that support dies 204*a*, 204*b* and punches 202*a*, 202*b*. A work piece 203 is upset in the directions indicated by the dashed arrows by the punches 202*a*, 202*b*, noting that only one punch may be utilized in certain forge processing with the other remaining stationary.

Figure 4:
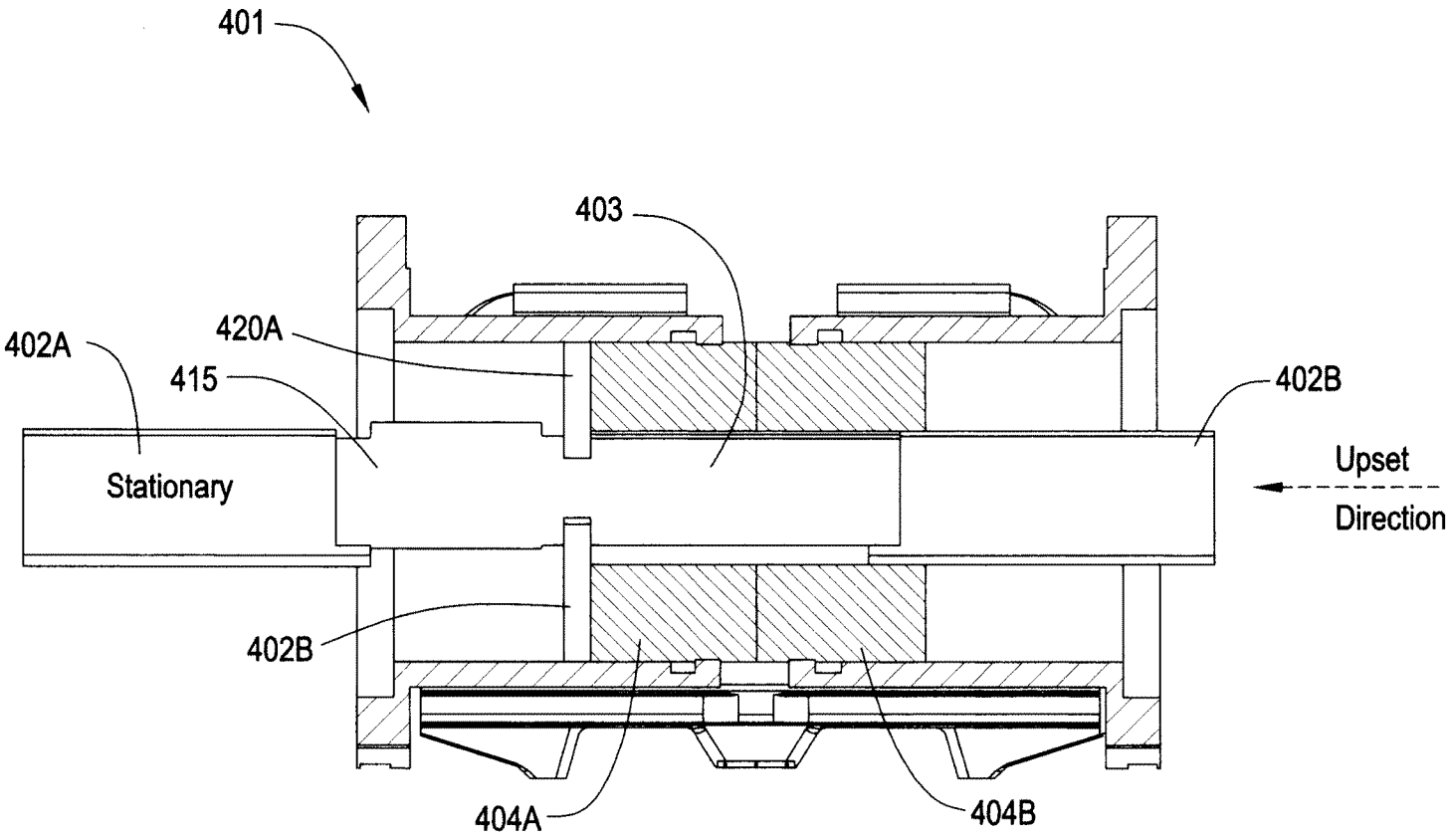
FIG. 4 illustrates an example cross-sectional front view of another example press having multiple work pieces formed from a single bar.

For example, as illustrated in FIG. 4, punch 202*a* of FIG. 2 may remain stationary or be replaced by another stationary part, indicated at 402*a*. Additional tooling and controlled movements may be implemented in press 401 that allows for the first formed manifold net shaped forge block 415 (formed using movement of punch 402*b* and dies 404*a*, 404*b*) to be advanced (in the example of FIG. 4, leftward), followed by its removal using tooling 420*a*, 420*b*, and continued processing of a next work piece 403 from the same long bar. This may require bar preparation (e.g., saw cutting prior to heat treatment of the bar) and may require increased clamping tonnage, and may result in increased friction. However, material savings (e.g., less extension required) and serial type processing of manifold blocks may be accomplished in this way.

Referring back to FIG. 2, clamping rams 206*a*, 206*b* maintain the centerline. As the work piece 203 is upset, it is also displaced into a net shaped forging by virtue of punch 202*a*, 202*b* movement and the shape of the dies 204*a*, 204*b*. Press 201 includes controls to precisely position the work piece 203 before, during and after the forging process.

It should be noted that the two dies 204*a*, 204*b* may be replaced with other dies or other dies may be used in combination with dies 204*a*, 204*b*. By way of non-limiting example, a triplex manifold block may be formed using two dies 204*a*, 204*b* whereas a center container die may be added between dies 204*a*, 204*b* (not explicitly illustrated) in order to elongate the overall die and form a quintuplex manifold block.

Punches 202*a* and 202*b* may also include cup features 207*a*, 207*b* (indicated at the area bounded by the dashed boxes in FIG. 2). Cup features 207*a*, 207*b* act as cups and support the work piece 203 from both ends. At the start of a stroke, as illustrated in FIG. 2, the press 201 is pre-positioned using upsetting rams. The press 201 is thereafter controlled to allow for precise positioning work piece 203 for further upsetting and thus displacement.

Figures 3A, 3B, 3C:
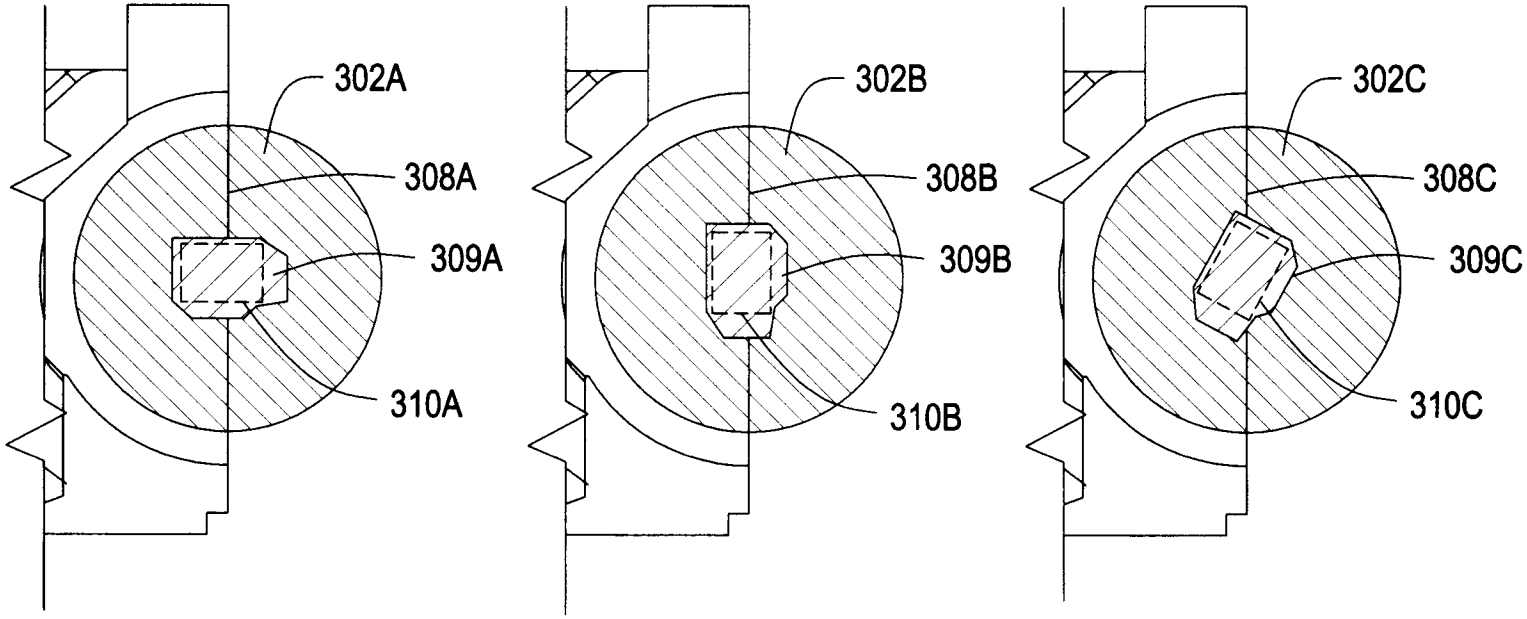
FIG. 3(A-C) illustrates example cross-sectional views along axis A-A of FIG. 2

The dies, e.g., 202*a*, may be formed in different ways, e.g., depending on the application. For example, FIG. 3(A-C) illustrates cross-sectional views of a press along section A-A of FIG. 2. In the example of FIG. 3A, a centerline 308*a* of the die 302*a* indicates where the die separates to allow the work piece, initial positioning in cross-sectional area thereof indicated at 310*a* (dashed line), to be inserted into a shaped cavity 309*a*. Once one or more punches upset the work piece, the work piece is shortened in length and displaced into the contours of the die 302*a* according to shape of cavity 309*a*. FIG. 3(A-C) show different starting orientations of a work piece, indicated at 310*a*, 310*b* and 310*c*, respectively. Different initial orientations for the work piece are possible, as are different internal cavity shapes, e.g., 309*a*, 309*b*, and 309*c*. This may impact the clamping tonnage required and may impact the location of the die separation 308*a*, 308*b*, and 308*c*.

FIG. 5(A-D) illustrates example views of a net shape forged manifold block for a fluid end. FIG. 5A illustrates a net shape forging of a fluid end manifold block in a perspective view. FIG. 5B illustrates an example top view, whereas FIG. 5C illustrates an example front view. FIG. 5D illustrates a cross-sectional view along section A-A of FIG. 5C. In FIG. 5D the solid outer line represents the outline of the net shape forging. The inner cross hatched area of FIG. 5D illustrates the final machined forging.

Figure 5A:
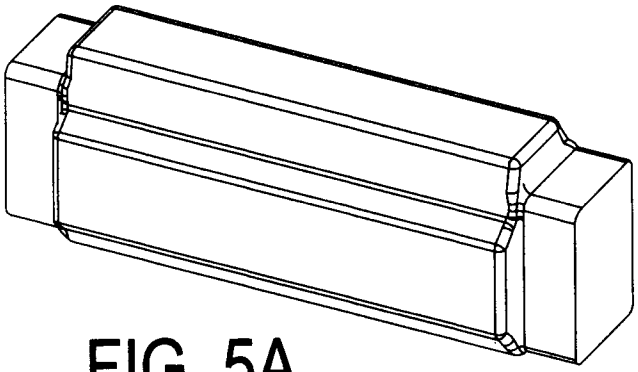
FIG. 5 (A-D) illustrates example net shape forged fluid ends.
Figure 5D:
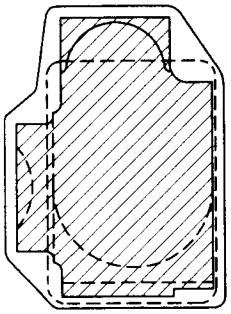
Figure 5B:
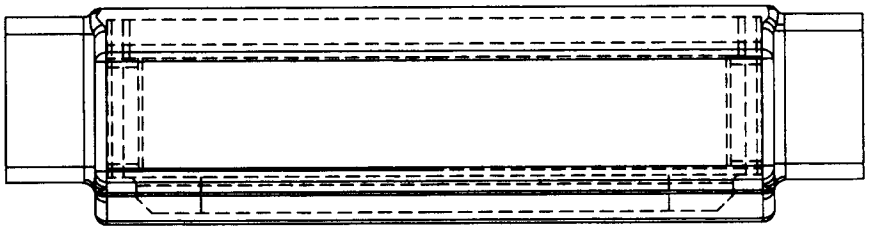
Figure 5C:
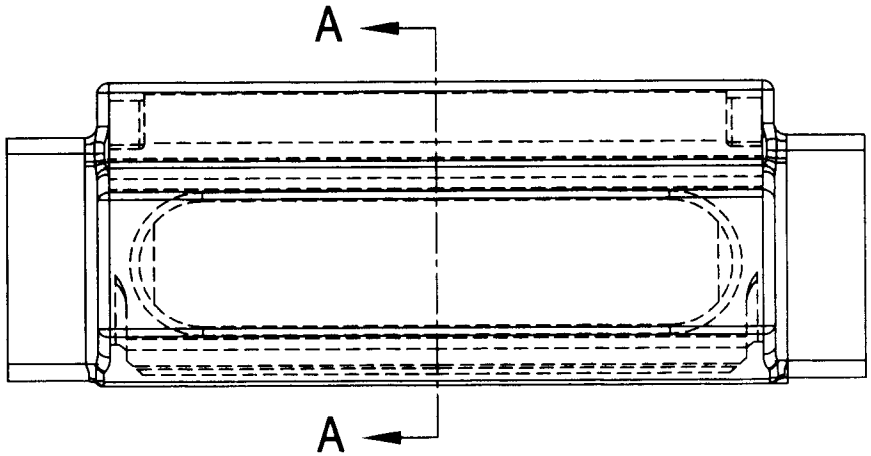

FIGS. 5B and 5C, show the plan (top) view and front view of the proposed forging, respectively. The dotted lines within these views show the outline and geometric features of the machined component that lies within the forging. FIG. 5D shows a section view, namely Section A-A of FIG. 5C, with the hatched pattern being the cross-section of the machined component at this location. The dotted lines in FIG. 5D additionally show a) the rectangular cross-section of the input material that remains as an extension on the forging, and, b) the outline of the machined component behind the section view within the forging.

The end extensions on the forging illustrated in FIG. 5 are the starting/input bar or stock. That is, the extensions represent the starting material prior to the net shaped forging process being applied. This illustrates an example of the relative change in the stock input bar as compared to a net shaped forging output of the process.

Figure 6:
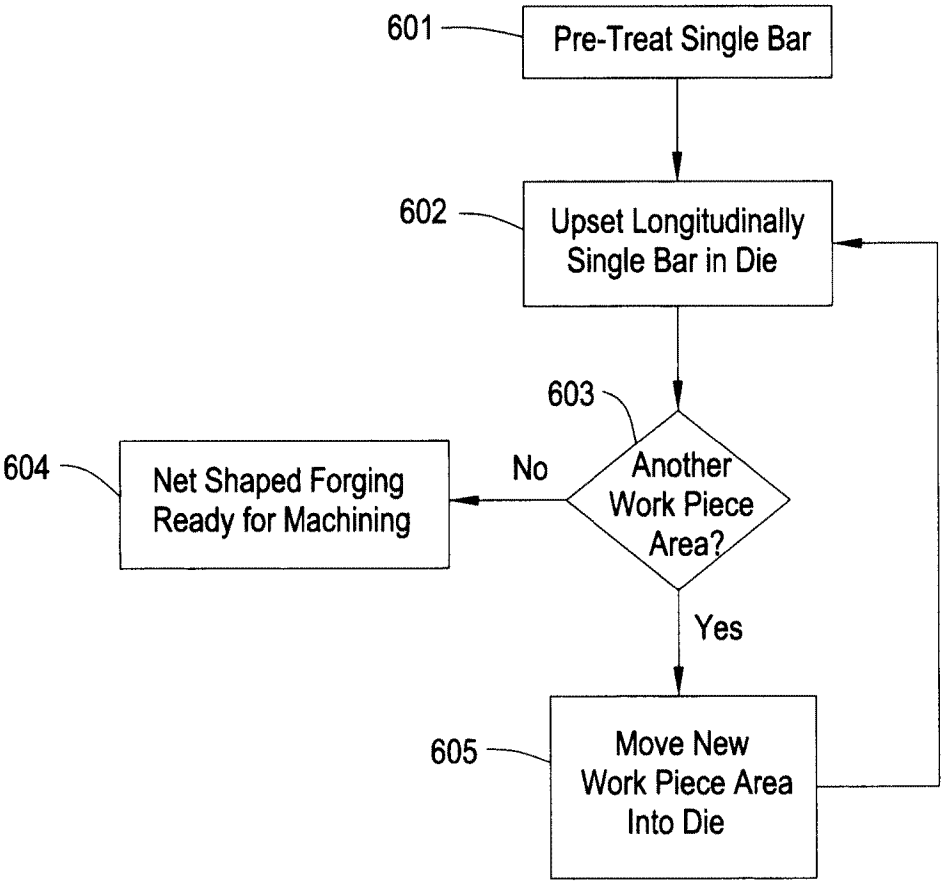
FIG. 6 illustrates an example method of net shape forging a fluid end.

An example method of net shape forging of fluid end(s) is illustrated in FIG. 6. As described herein, optionally pre-treatment of the single bar (e.g., saw cutting) may be provided at 601. Starting with a single bar having a first cross-sectional area, a work piece area of the single bar is placed in the die and upset, via longitudinal movement of the single bar, at 602. This results in the work piece area of the single bar in the die being pressed into the die, reducing its length. As may be appreciated, the work piece area of the single bar is displaced to an increased cross-sectional area as compared to the first (original, starting) cross-sectional area. The net shape of the forging may be produced essentially in a single stroke via upsetting of the work piece to displace material of the work piece area into a shaped cavity of the die.

If there are no further manifold blocks to be formed from the single bar (multiple manifold blocks may be formed), as determined at 603, a net shaped forging of the manifold block has been produced, which may be removed from the die and sent on form post processing (including machining) at 604.

If there are further manifold blocks to be formed, as determined at 603, a new area of the single bar is introduced into the die as a new work piece area at 605. Thereafter, the longitudinal movement or pressing of the single bar, with the new work piece area in the die, is performed, similar to step 602. This process may repeat until it is determined that the end of the single bar has been processed, i.e., there are no new work pieces to be processed from the single bar.

Once a manifold block is formed, either as a single manifold block or in a series of manifold blocks, it may be removed from the single bar as a net shape forged manifold block. This may be done for each new manifold block formed from the single bar, such that the work piece area of the single bar is always a terminal end of the single bar.

As will be appreciated by those having ordinary skill in the art, a press such as that illustrated herein may be automated or semi-automated. That is, a press may include a process and a memory that cooperate to execute code or instructions to move parts of the press (e.g., move a work piece area into a die, operate a punch or pressing part, position or reposition die(s), etc.) such that the single bar may be processed in an automated or semi-automated manner.

Furthermore it should be noted that while the term "bar" has been used herein, this term should be construed broadly to include any starting material shape. The bar may be circular, semi-circular, rectangular, etc. The bar starting material is of a first, smaller or reduced diameter, and has its cross sectional area or diameter increased upon upsetting and displacement, as described herein. Furthermore, the bar is pressed or upset such that its overall length or longitudinal dimension is reduced by the forging processes.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

In the specification there has been set forth example embodiments and, although specific terms are used, the description thus given uses terminology in a generic and descriptive sense only and not for purposes of limitation.

Finally, any numerical parameters set forth in the specification and claim(s) are approximations (for example, by using the term "about" or the phrase "at least" and the like) that may vary depending upon the desired properties sought to be obtained by the embodiment(s). At the very least, each numerical parameter should at least be construed in light of the number of significant digits and by applying ordinary rounding.

What is claimed is:

1. A method for net shape forging of a manifold block, comprising:

starting with a single bar having a first cross-sectional area, placing a work piece area of the single bar in a die;

upsetting, via longitudinal movement of the single bar, the work piece area of the single bar in the die, wherein the single bar is pressed into the die to reduce its length and net shape forging the single bar via displacing the single bar during the upsetting;

and removing the work piece area from the single bar as a net shape forged manifold block;

whereby the work piece area of the single bar is displaced to an increased cross-sectional area as compared to the first cross-sectional area.

2. The method of claim 1, wherein the upsetting of the work piece area results in displacement of the work piece area into a shaped cavity of the die.

3. The method of claim 1, further comprising moving the work piece area of the single bar longitudinally out of the die.

4. The method of claim 3, further comprising introducing a new area of the single bar into the die as a new work piece area.

5. The method of claim 4, further comprising upsetting, via longitudinal movement of the single bar, the new work piece area, wherein the single bar is pressed into the die to reduce its length.

6. The method of claim 1, further comprising pre-treating the single bar prior to forging the bar.

7. The method of claim 6, wherein the pre-treating includes saw cutting the single bar.

8. The method of claim 7, wherein saw cuts are introduced at manifold block separation areas of the single bar.

9. The method of claim 1, wherein the manifold block is a fluid end.

* * * * *